US006357516B1

(12) United States Patent
Judge et al.

(10) Patent No.: US 6,357,516 B1
(45) Date of Patent: Mar. 19, 2002

(54) PLATE HEAT EXCHANGER ASSEMBLY WITH ENHANCED HEAT TRANSFER CHARACTERISTICS

(75) Inventors: John F. Judge, Stewartstown; Keith E. Starner, York, both of PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 09/495,917

(22) Filed: Feb. 2, 2000

(51) Int. Cl.[7] ..... F28F 13/12; F28F 13/16; F28F 3/08

(52) U.S. Cl. ..... 165/96; 165/167; 165/166

(58) Field of Search ..... 165/96, 166, 167

(56) References Cited

U.S. PATENT DOCUMENTS

| | | | | |
|---|---|---|---|---|
| 3,370,644 A | * | 2/1968 | Daily et al. | 165/95 |
| 3,633,337 A | | 1/1972 | Walker et al. | |
| 3,734,172 A | | 5/1973 | Clifford | |
| 4,207,942 A | | 6/1980 | Cowan et al. | 165/167 X |
| 4,471,833 A | * | 9/1984 | Yabe et al. | 165/109.1 |
| 4,651,806 A | | 3/1987 | Allen et al. | 165/96 |
| 4,800,007 A | | 1/1989 | Karlsson et al. | |
| 4,903,758 A | | 2/1990 | Cowan | |
| 5,072,780 A | | 12/1991 | Yabe | 165/96 |
| 5,769,155 A | | 6/1998 | Ohadi et al. | 165/96 X |

FOREIGN PATENT DOCUMENTS

| | | | | |
|---|---|---|---|---|
| SU | 918763 | * | 4/1982 | 165/96 |

* cited by examiner

*Primary Examiner*—Leonard Leo
(74) *Attorney, Agent, or Firm*—Finnegan, Henderson, Farabow, Garrett & Dunner, L.L.P.

(57) ABSTRACT

A plate heat exchanger for accommodating a circulating refrigerant and heat transfer fluid. The plate heat exchanger includes a plurality of heat transfer plates and at least one electrode plate. The plurality of heat transfer plates are mounted in parallel relationship to each other defining alternating flow spaces for a refrigerant and a heat transfer fluid. The electrode plate is located in each refrigerant flow space and is spaced from the adjacent heat transfer plates. The electrode plate includes outer electrode surfaces on each side thereof to produce an electric field. The effect of the electric field is an increase in the heat transfer rate between the refrigerant and heat transfer fluid. The invention also includes a method of exchanging heat between a heat transfer fluid and a refrigerant in a plate heat exchanger.

30 Claims, 8 Drawing Sheets

PLATE HEAT EXCHANGER ASSEMBLY WITH ENHANCED HEAT TRANSFER CHARACTERISTICS

BACKGROUND OF THE INVENTION

1. Field of the Invention

This invention relates to heat exchanger evaporators and condensers, particularly those used in HVAC applications. The invention relates to a plate heat exchanger evaporator, where the refrigerant flows through the plates and evaporates, while a heat transfer fluid flows through adjacent plates and is cooled by the evaporating refrigerant. The invention also relates to a plate heat exchanger condenser. In a preferred embodiment, the evaporator is a component of a refrigeration system which can be used for cooling large quantities of water. This invention relates to an apparatus and method for increasing the heat transfer rate of these types of heat exchangers.

2. Description of the Related Art

Refrigeration systems of the type used to cool large quantities of water typically include a heat exchanger evaporator having separated passageways. One passageway carries refrigerant, and another carries the heat transfer fluid to be cooled, usually water. As the refrigerant travels through the evaporator, it absorbs heat from the heat transfer fluid and changes from a liquid to a vapor phase. After exiting the evaporator, the refrigerant proceeds to a compressor, then a condenser, then an expansion valve, and back to the evaporator, repeating the refrigeration cycle. The fluid to be cooled passes through the evaporator in separate fluid channels and is cooled by the evaporation of the refrigerant. The fluid can then be routed to a cooling system for cooling the spaces to be conditioned, or it can be used for other refrigeration purposes.

It is desirable to optimize the heat transfer rate between fluids flowing through sa heat exchanger, particularly large heat exchangers used in heating and air conditioning systems. A number of approaches have been proposed to improve the heat transfer characteristics of evaporators and condensers. One generally known approach is to create an electric field on a heat transfer surface in order to improve heat transfer. The use of an electric field to improve the heat transfer of convection heat transfer in a liquid is generally referred to as the electrohydrodynamic effect or EHD. Applications of this approach are disclosed in U.S. Pat. No. 4,651,806 to Allen et al., U.S. Pat. No. 5,072,780 to Yabe, and U.S. Pat. No. 5,769,155 to Ohadi et al.

SUMMARY OF THE INVENTION

The object of the present invention therefore is to provide improved heat exchanger methods and systems. Another object is to provide improved heat exchangers for HVAC applications that are more efficient and more compact than conventional heat exchangers.

The advantages and purposes of the invention will be set forth in part in the description which follows, and in part will be obvious from the description, or may be learned by practice of the invention. The advantages and purposes of the invention will be realized and attained by means of the elements and combinations particularly pointed out in the appended claims.

To attain the advantages and in accordance with the purposes of the invention, as embodied and broadly described herein, the invention includes a plate heat exchanger for accommodating a circulating refrigerant and heat transfer fluid. The plate heat exchanger includes a plurality of heat transfer plates and at least one electrode plate. The plurality of heat transfer plates are mounted in parallel relationship to each other defining alternating flow spaces for a refrigerant and a heat transfer fluid.

The electrode plate is located in each refrigerant flow space and is spaced from the adjacent heat transfer plates. The electrode plate includes outer electrode surfaces on each side thereof to produce an electric field. The effect of the electric field is an increase in the heat transfer rate between the refrigerant and heat transfer fluid. The plate heat exchanger typically includes a plurality of refrigerant flow spaces and corresponding electrode plates located therein.

In a further aspect of the invention, the invention includes a plate heat exchanger for accommodating two circulating heat exchange mediums. The plate heat exchanger includes a plurality of heat transfer plates and an electrode plate. The plurality of heat transfer plates are mounted in parallel relationship to each other to define alternating fluid channels comprising first and second fluid channels. The first fluid channel is for containing a first heat exchange medium, and the second fluid channel is for containing a second heat exchange medium. An electrode plate is located in each first fluid channel and is positioned generally parallel to and spaced from the heat transfer plates.

The electrode plate includes outer electrode surfaces on each side thereof to produce an electric field. Either the outer electrode surfaces of each electrode plate, or the surfaces of the heat transfer plates surrounding each electrode plate and defining the first fluid channel, include surface irregularities. The effect of the electric field on the surface irregularities is an increase in the heat transfer rate between the first heat exchange medium and the second heat exchange medium.

In a yet further aspect of the invention, the invention includes a method of exchanging heat between a heat transfer fluid and a refrigerant in a plate heat exchanger. In the method of the present invention, a plurality of parallel heat transfer plates are provided. An electrode plate is also provided inside each of a plurality of first flow spaces defined by first surfaces of adjacent heat transfer plates. Next, a refrigerant is flowed through the plurality of first flow spaces, and a heat transfer fluid is flowed along a second surface of each of the heat transfer plates. The second surfaces of adjacent heat transfer plates to define a second flow space for the heat transfer fluid. Lastly, a voltage is applied to the electrode plates to create an electric field, the electric field increasing the heat transfer rate between the refrigerant and the heat transfer fluid. The method may also include the step of forming surface irregularities on either the first surfaces of the heat transfer plates or on the surfaces of the electrode plates.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

In the drawings.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

While the present invention has broader application regarding a heat exchanger assembly for transferring heat between fluids flowing in the spaces between a plurality of adjacent plates, the invention was developed and has particular application as an evaporator or condenser assembly in an HVAC chiller system. The plate heat exchanger will first be described as an evaporator for sake of ease of discussion. The use of the plate heat exchanger as a condenser will be briefly described later in the specification.

In accordance with the present invention, a plate heat exchanger is provided with an increased heat transfer rate due to an electric field created by an applied voltage on an electrode plate. The plate heat exchanger is generally comprised of a stacked array of heat transfer plates mounted in parallel relationship to each other, and a plurality of electrode plates.

Figure 1:
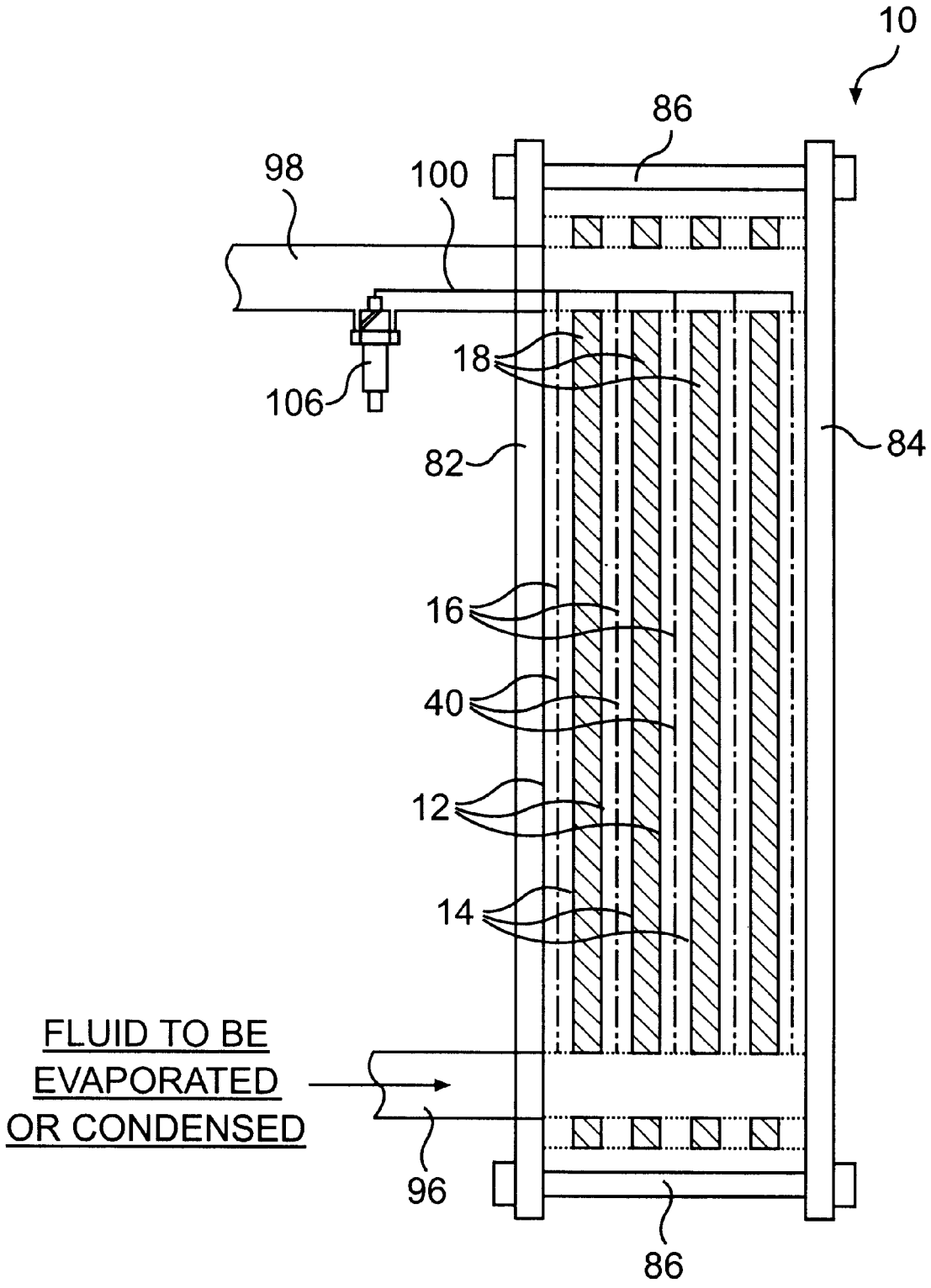
FIG. 1 is a cross-sectional side view of a plate heat exchanger according to the present invention.
Figure 4:
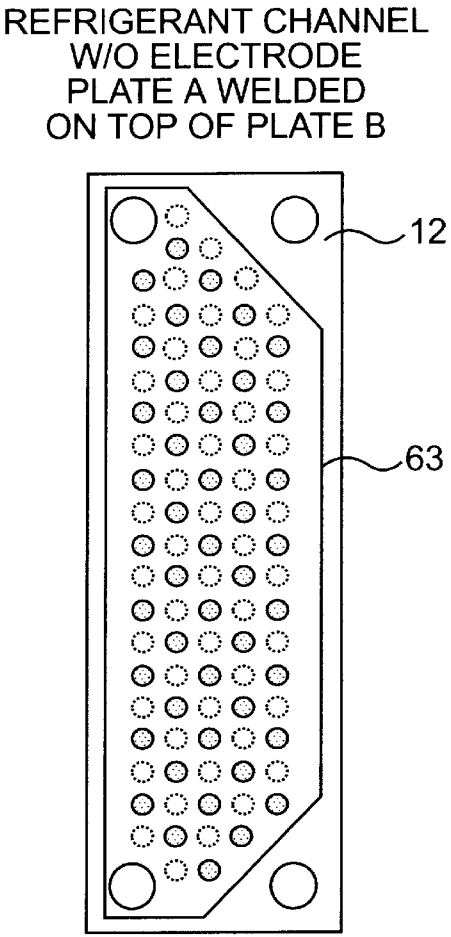
FIG. 4 is a front view of the first heat transfer plate of the plate heat exchanger of FIG. 1, after the first heat transfer plate has been stacked onto the second heat transfer plate.
Figure 3:
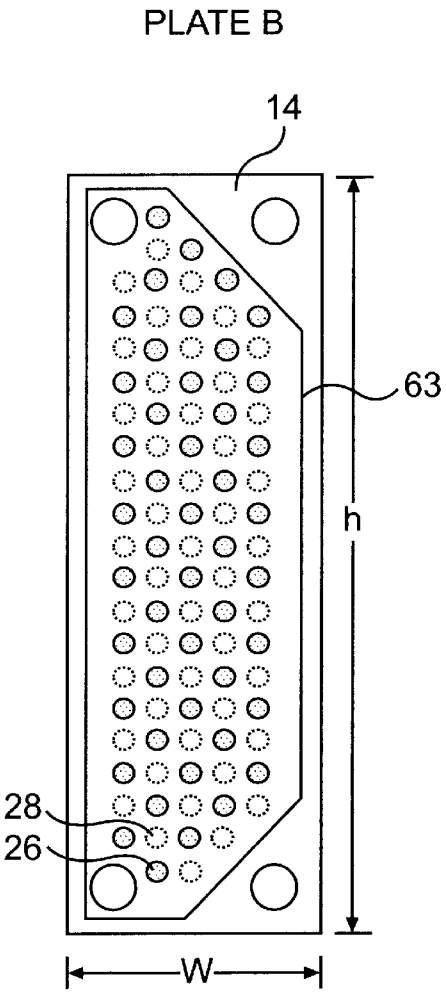
FIG. 3 is a front view of a second heat transfer plate of the plate heat exchanger of FIG. 1, prior to assembly.
Figure 2:
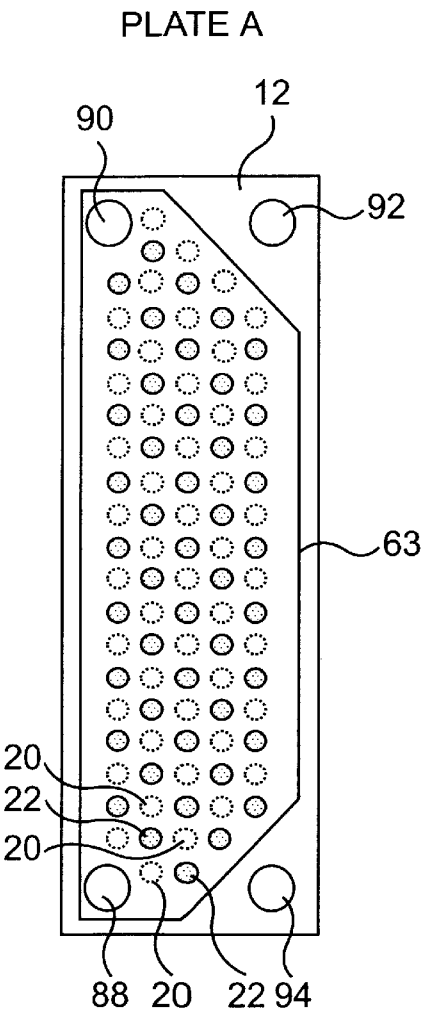
FIG. 2 is a front view of a first heat transfer plate of the plate heat exchanger of FIG. 1, prior to assembly.
Figure 9:
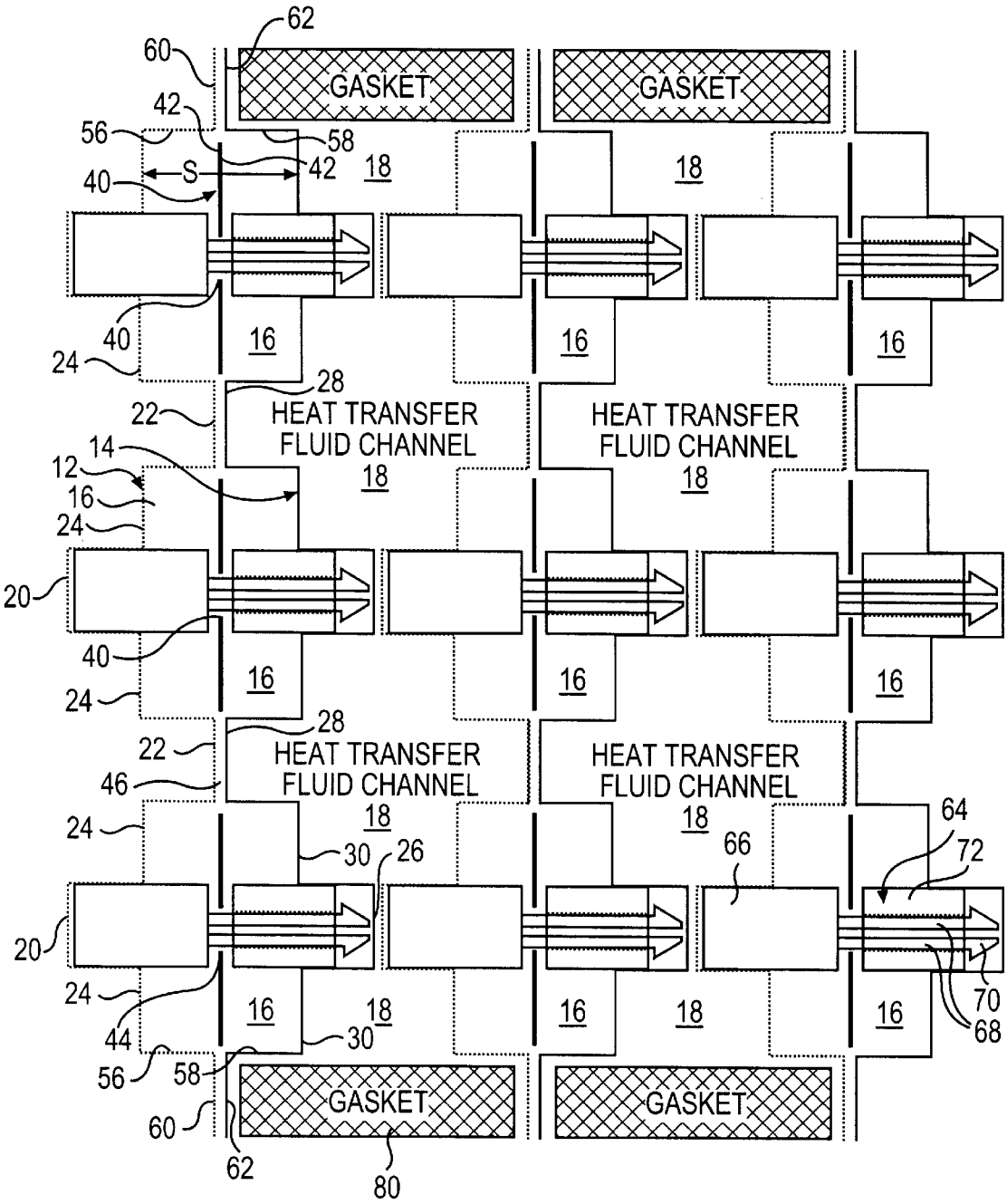
FIG. 9 is a schematic cross-sectional view of the plate heat exchanger of FIG. 1 with the insulators and electrode plates installed.

In accordance with the present invention, the plate heat exchanger includes a plurality of heat transfer plates. In the embodiment shown in FIGS. 1–10, the plate heat exchanger 10 includes a stacked array of first heat transfer plates 12 and second heat transfer plates 14. The first heat transfer plates 12 and second heat transfer plates 14 are stacked one on top of the other in a parallel relationship to define alternating first and second flow channels 16 and 18, respectively. The specific shape of the heat transfer plates shown in the drawings is only one example and should be used for explanatory purposes only. The present invention is compatible with a wide variety of heat transfer plate designs. As best shown in FIGS. 2–3 and 9, the first and second heat transfer plates 12 and 14 of the exemplary heat exchanger are in the shape of thin plates across which heat is transferred between two mediums. The thickness of the plates may be varied depending upon the specific application. The plates 12 and 14 are typically rectangular in shape, however, other shapes can be contemplated. The plates 12 and 14 are spaced apart parallel to each other to define fluid channels that will be discussed below. The heat transfer plates 12 may be made out of any of a variety of materials known in the field, such as steel. The number and size of the heat transfer plates, and other components, depends on the requirements of the specific application.

In the embodiment shown in FIGS. 1–9, the heat transfer plates include a plurality of dimples. As shown in FIG. 2, the first heat transfer plate 12 has a plurality of alternating dimples in a grid-like pattern. For example, in FIG. 2, the dimples designated by reference number 20 (unshaded) are recesses going into the page, and the adjacent dimples designated by reference number 22 (shaded) are projections coming out of the page in FIG. 2. The dimples alternate between the recessed dimples 20 and projecting dimples 22 along each row and column of dimples.

The dimple configuration is best illustrated in FIG. 9. In the first heat transfer plate 12 to the far left in FIG. 9, a projecting dimple 20 is formed in flat surface 24. The dimple 20 projects to the left in FIG. 9, and is therefore called a projecting dimple. The adjacent dimple on the first heat transfer plate (going upward in FIG. 9) is a recessed dimple 22 formed in the flat surface 24 of the first heat transfer plate 12. The dimple 22 is recessed to the right in FIG. 9, and is therefore called a recessed dimple. The next dimple (going upward in FIG. 9) after recessed dimple 22 is a projecting dimple 20. For sake of ease of discussion, the dimples will hereinafter be referred to by their particular function. The projecting dimples 20 of the first heat transfer plate 12 will be referred to as insulator-engaging dimples 20 because insulators (to be described) are positioned in them as will be described in greater detail later in the specification. The recessed dimples 22 of the first heat transfer plate 12 will be referred to as structural support dimples 22 because they provide structural support to the heat exchanger by engaging with adjacent structural support dimples 28 of the adjacent plate. The schematic of FIG. 9 shows a space between the structural support dimples 22 and 28, however the structural support dimples actually contact each other.

The dimples 20 and 22 can be of a variety of sizes and shapes. In the illustrated embodiment, the dimples are cylindrical and are formed by stamping the flat surface 24 of the first heat transfer plate 12. Any suitable number of dimples may be provided, from 3 or 4 to several hundred. The figures show an embodiment with 93 dimples, however, this number can be greatly varied.

The second heat transfer plate 14 also includes a plurality of dimples. As shown in FIGS. 3 and 9, the second heat transfer plate has a plurality of alternating recessed and projecting dimples which are aligned with the dimples of the first heat transfer plate.

For example, immediately across from each insulator-engaging dimple 20 of the first heat transfer plate is a similar insulator-engaging dimple 26 in the second heat transfer plate 14. The insulator-engaging dimple 26 of the second heat transfer plate projects in the opposite direction of the corresponding dimple 20 of the first heat transfer plate. Immediately across from each structural support dimple 22 of the first heat transfer plate 12 is a similar structural support dimple 28 on the second heat transfer plate 14. The structural support dimple 28 of the second heat transfer plate 14 projects toward and contacts the corresponding structural support dimple 22 of the first heat transfer plate 12. The dimples of the second heat transfer plate 14 are stamped on the flat surface 30 of the second heat transfer plate in a similar fashion as described for the first heat transfer plate 12.

In plate heat exchangers, the heat transfer plates define a first fluid channel 16 and second fluid channel 18 for a first heat exchange medium and second heat exchange medium respectively. In a typical heat exchanger, the first heat exchange medium of the first fluid channels 16 is a refrigerant, and the second heat exchange medium of the second fluid channels 18 is a heat transfer fluid. Other types of fluids may also be used.

The first and second heat transfer plates define alternating first fluid channels 16 and second fluid channels 18. As shown in FIG. 9, a first fluid channel 16 is formed in the space between two adjacent heat transfer plates 12 and 14 in which an electrode plate, to be described below, is located. The first fluid channel 16 is defined by the flat surfaces 24 and 30 of the first and second heat transfer plates 12 and 14. The refrigerant will flow inside of the first fluid channel 16 and flow around the insulators, electrode plate, and structural support dimples in the flow path of the first fluid channel. As will be discussed, the electrode plates are placed substantially in the middle of the first fluid channels 16. The volume of refrigerant in the first fluid channel 16 is a function of the space "s" between the flat surfaces 24 and 30 of the first and second plates (FIG. 9), the width "w", and the height "h" (FIG. 3) of the heat transfer plates. The electrode plate, insulators, and structural support dimples 28 also take up some of the volume of the first fluid channels.

The fluid channels adjacent the first fluid channels are referred to as the second fluid channels or heat transfer fluid channels 18. Unlike the first fluid channels 16, the second fluid channels 18 do not contain electrode plates or insulators, as illustrated in FIG. 9. First fluid channels 16 and second fluid channels 18 do not fluidly communicate with one another. The heat transfer fluid flows through the second fluid channels 18.

During operation of the plate heat exchanger, a first fluid comprising a refrigerant flows in an upward direction inside the first fluid channels 16, while a second fluid comprising a heat transfer fluid simultaneously flows in a downward direction in the second fluid channels 18. In the first fluid channels 16, the refrigerant absorbs heat from the water or other heat transfer fluid in the second fluid channels 18 and evaporates in whole or part. In the second fluid channels 18, the heat transfer fluid transfers heat to the refrigerant, and decreases in temperature.

In HVAC applications, the first fluid in an evaporator is a refrigerant. A variety of different types of refrigerants can be used with the present invention. Examples of refrigerants suitable for the present invention include, but are not limited to, R-22, R-134a, and R-407C. The selection of the type of refrigerant can have an effect on other factors such as pressure drop in the fluid channels and the amount of heat transfer to or from the heat transfer fluid.

In accordance with the present invention, the heat exchanger includes a plurality of electrode plates. As embodied herein and shown in FIGS. 5 and 9, an electrode plate 40 is located in each first fluid channel 16, and includes outer electrode surfaces 42 on each side thereof. The electrode plates also include holes 44 for the insulators, and holes 46 for the structural support dimples 26 and 28. The electrode plates 40 can be a variety of shapes and sizes. In the embodiment, the electrode plate is a thin plate of steel or copper, although other suitable materials and shapes are also acceptable. The electrode plates can be made out of any of the conventional materials typically used for electrodes. The material can be virtually any type of conductive metal.

Figure 6:
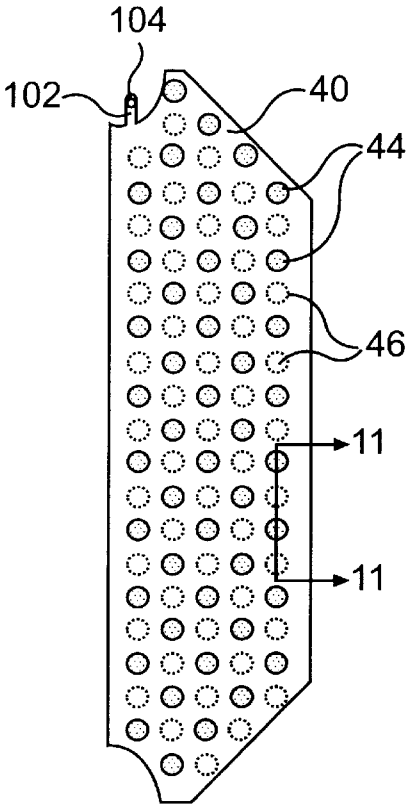
FIG. 6 is a front view of an electrode plate of the plate heat exchanger of FIG. 1.

As shown in FIGS. 6 and 9, the electrode plate 40 includes the same number of holes as dimples in the heat transfer plates. The holes are arranged in a grid-like pattern identical to the dimple arrangement of the first and second heat transfer plates.

The insulator holes 44 in the electrode plate are aligned with the insulator-engaging dimples 20 and 26 of the first and second heat transfer plates. An insulator structure, to be described later, passes through and engages with a corresponding insulator hole 44. The electrode plate 40 is thereby supported and maintained in a constant position in the first fluid channel 16. The electrode plate also holes 46 for allowing the structural support dimples 22 and 28 to engage each other inside. The structural support holes 46 are sized to be slightly larger than the structural support dimples so that the structural support dimples can pass through the hole without contacting the electrode plate. This clearance minimizes the risk of shock on the heat exchanger by maintaining the heat exchanger to be electrically isolated from the voltage of the electrode. spaced from each other, the end surfaces of the dimples are actually firmly pressed against each other. The structural support dimples, in addition to the insulators, contributes to equal spacing between the heat transfer plates and helps to minimize bending and expansion of the heat transfer plates. It should be understood that in all application with low fluid pressure and small amounts of fluid flow, the structural support dimples 22 and 28, and the corresponding structural support holes 46 in the electrode plate may not be necessary.

Figure 5:
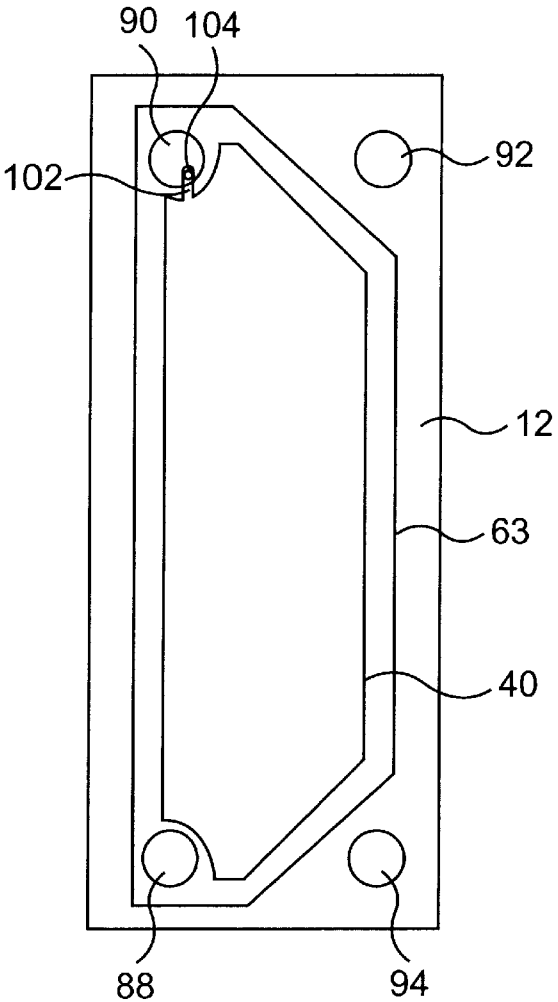
FIG. 5 is a front view of a heat transfer plate with an electrode plate placed on top of a heat transfer plate of FIG. 1.

As shown in FIGS. 6 and 9, the electrode plates 40 include outer electrode surfaces 42 on each side thereof. The refrigerant flowing in the first fluid channels 16 flows along the outer electrode surfaces 42. The provision of an electrode plate 40 in the first fluid channels 16 provides enhanced heat transfer between the refrigerant flowing in the first fluid channel and the heat transfer fluid flowing in the second fluid channel, for reasons which will be described below. It is preferable to place the electrode plate 40 in the first fluid channel 16 equally spaced between the first and second heat transfer plates 12 and 14 in order to provide equal electric fields on both sides of the electrode plate. Preferably, the electrode plate is configured to be only slightly spaced from the edge, or outer periphery, 56 and 58, of the first and second heat transfer plates, as best shown in FIGS. 5 and 9. FIG. 5 shows the positioning of the electrode plate relative to a heat transfer plate. The holes in the electrode plate have been removed in FIG. 5 in order to simplify the drawing. The plate heat exchanger is designed to maximize the amount of heat transfer surface covered by the electrode plate while also avoiding electrical contact with the heat transfer plates. In the embodiment shown, the electrode plate is roughly trapezoidal.

The refrigerant channels 16 are sealed by end surfaces 60 and 62 of the first and second heat transfer plates. The end surface 60 of the first heat transfer plate 12 is recessed from the flat surface 24 of the first heat transfer plate in a manner similar to structural support dimples 22. The end surface 62 of the second heat transfer plate 14 is recessed from the flat surface 30 of the heat transfer plate in a manner similar to structural support dimples 30. The first and second heat transfer plates are typically welded together at end surfaces 60 and 62 along weld line 63. Other suitable attachment methods, such as press fitting, are also acceptable.

When the plate heat exchanger is used as an evaporator, the outer electrode surfaces 42 of each electrode plate 40 will be substantially smooth (except for holes 44 and 46). The smoothness of the outer electrode surfaces 42 minimizes the electric field intensity along the surfaces 42. The flat surfaces 24 and 30 of the first and second heat transfer plates along which the refrigerant flows in the refrigerant channels 16 are provided with surface irregularities. The provision of surface irregularities on these refrigerant flow surfaces of the heat transfer plates 12 and 14 increases the surface area of the refrigerant flow surfaces in order to increase the heat transfer which occurs across the heat transfer plates 12 and 14. The electrode plate 40 produces an electric field on the refrigerant flow surfaces of the heat transfer plates when a voltage is applied to the electrode plate. The electric field is intensified at the surface irregularities, causing the liquid refrigerant to be pressed against the inner surface irregularities of the refrigerant flow surfaces of the heat transfer plates, thereby increasing the heat transfer rate significantly.

The inner surface irregularities on the refrigerant flow surfaces of the heat transfer plates 12 and 14 can be of a wide variety of sizes and shapes. The inner surface irregularities can be virtually any type of surface irregularity including, but not limited to, cross-groove microfins, porous coatings, scratched surfaces, sintered surfaces, abraided surfaces (such as sand blasted surfaces), and dimpled surfaces. The surface merely needs to have numerous acute peaks and valleys so that the electric field is intensified along the refrigerant flow surfaces. Almost any type of surface irregularity will be useful with the present invention.

It is desirable to maximize the roughness of the refrigerant flow surfaces of the heat transfer plates for evaporation. As the surface becomes more rough, the electric field becomes more intense. The electric field becomes particularly intense at the sharp points of the surface roughness. An additional benefit of increasing the roughness of the surface is that less voltage is required. Theoretically, the ideal shape for the irregularities would be infinitely thin needles that extend radially from the refrigerant flow surfaces to just short of the outer surface 42 of the adjacent electrode plate 40. This shape will draw the maximum electric field around the irregular surface, thereby maximizing the heat transfer rate. Much less power is needed in order to obtain the desired heat transfer characteristics with such a shape. However, it may not be feasible to have such a design because of practical constraints such as electrode plate manufacturing limitations. It is believed that the optimum design will be a compromise, achieved by balancing the various factors such as electric field, pressure drop, fluid flow, and shape and size of the surface irregularities, to achieve a optimum design for a given heat exchanger.

While it is desirable to maximize the roughness of the inner surfaces of the heat transfer plates defining the refrigerant channel, it is also desirable to minimize the size of the gap between the electrode plate and the refrigerant flow surfaces of the heat transfer plates. The optimum size of the gap takes into consideration both the size of the surface irregularities and the resulting pressure drop from the gap. It is desirable to have the gap be only slightly larger than the surface roughness. However, if the gap is too small, the pressure drop will become too large. Therefore, it is important to balance these considerations for each specific application.

In accordance with the present invention, and as previously discussed, insulators are provided for electrically insulating each electrode plate from the adjacent heat transfer plates and for supporting the electrode plate in its respective refrigerant channel. As embodied herein and shown in FIGS. 7 and 9, a plurality of electrode insulators 64 prevent the electrode plate 40 from making electrical contact with the heat transfer plates 12 and 14. The insulators can be of any variety of sizes and shapes. In the embodiment shown in FIGS. 6 and 9, insulators 64 include a first cylindrical portion 66, flexible cantilever projections 68, ramped protrusion 70, and an outer hollow cylindrical member 72. The first cylindrical portion 66 is sized to closely fit inside the insulator dimple 20 of the first heat transfer plate so that the insulator 64 is held firmly within dimple 20. The projections 68 extend axially from the first cylindrical portion 66, and are flexible. The projections are sized to fit inside the insulator holes 44 of the electrode plate. The ramped protrusions 70 form a snap fit connection with the outer hollow cylindrical member 72. The outer cylindrical member 72 is sized to closely fit inside the insulator dimple 26 of the second heat transfer plate so that the insulator is firmly held within dimple 26.

Figure 7:
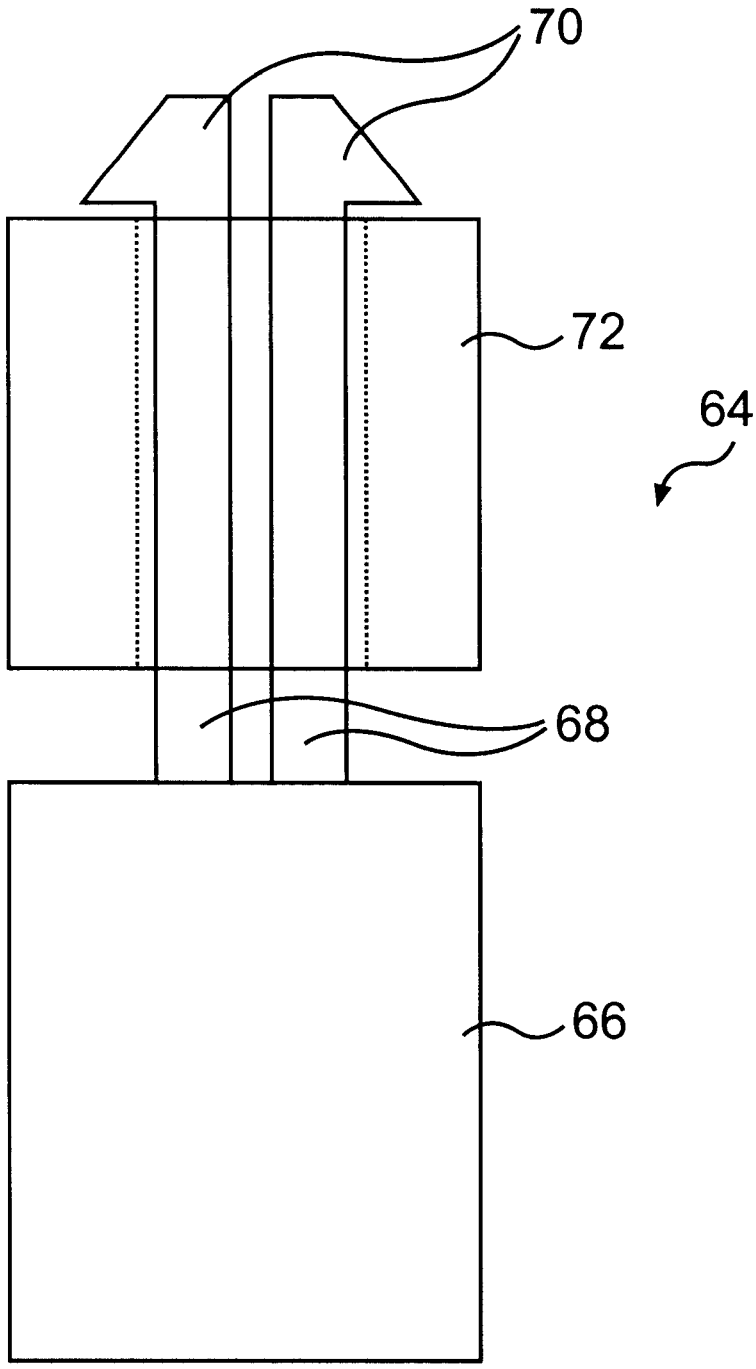
FIG. 7 is a partial cross-sectional view of an insulator for an electrode plate according to an embodiment of the present invention.
Figure 8:
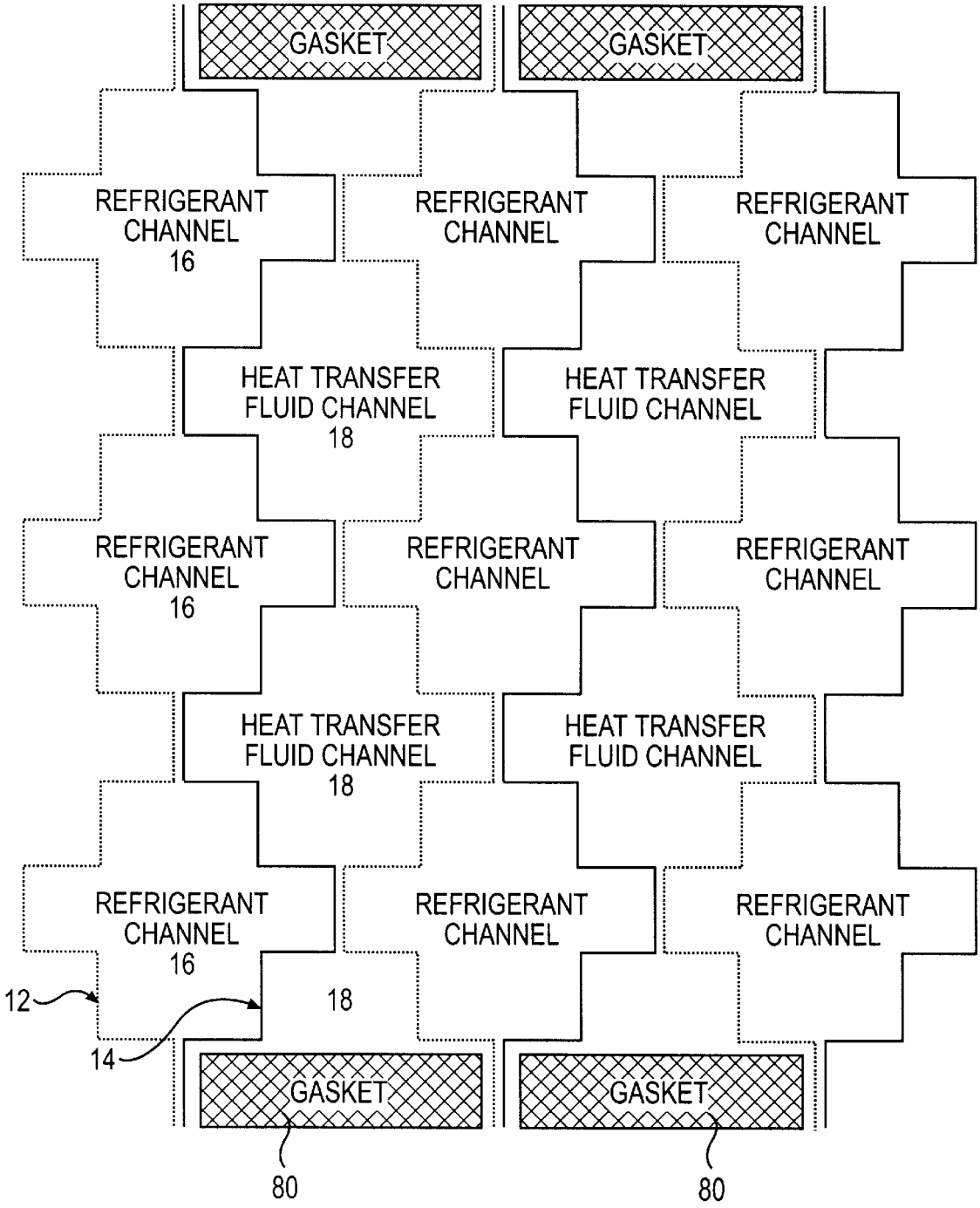
FIG. 8 is a schematic cross-sectional view of the plate heat exchanger of FIG. 1 with the insulators and electrode plates removed.

Insulators 64 support the electrode plate so that the electrode plate 40 is positioned midway between the refrigerant flow surfaces of the refrigerant channel 16. Insulators 64 also prevent the electrode plate 40 from contacting any portion of the heat transfer plates. The number of insulators matches the number of insulator holes in the electrode, as well as the number of insulator dimples for each pair of first and second heat transfer plates. A smaller or greater number of insulators can be used. Insulators can be made out of any type of suitable insulating material, typically plastic or ceramic. The insulators can be of a variety of sizes and shapes. The insulators shown in FIGS. 7 and 9 are exemplary only.

The pairs of heat transfer plates can be assembled by a variety of methods. In a typical method of the present invention, the insulators 64 are placed in each of the insulator holes 44 of the electrode plate. While inserting the ramped protrusions 70 into the insulator holes 44 of the electrode plate, the ramped protrusions are squeezed together so they fit inside the holes 44. The electrode plate 40 is then slid along the length of the projections 68. The outer hollow cylindrical member 72 is then slid over the ramped projections and snapped into position once the ramped projections extend completely through the cylindrical member 72. The insulators 64 can now be slid into the insulator dimples 20 of the first heat transfer plate 12. Next, the second heat transfer plate 14 is positioned over the hollow cylindrical member 72 and the insulators are slid into each of the aligned insulator dimples 26 of the second heat transfer plate 14. The first and second heat transfer plates are now squeezed together so that the structural support dimples 22 and 28 are firmly pressed against each other, and so that the insulators are tightly positioned inside their corresponding insulator dimples. The end surfaces 60 and 62 can now be attached together by any known method, such as welding, in order to form the refrigerant channels 16.

These pairs of first and second heat transfer plates, can be stacked on top of one another to form the heat exchanger. A sealing member, such as gasket 80 shown in FIG. 9, may be positioned between the pairs of first and second heat transfer plates, in order to define the outer periphery of the heat transfer fluid channels 18. In one embodiment, the pairs of first and second heat transfer plates can be stacked on top of one another, with gaskets therebetween, and squeezed between two end plates 82 and 84 by bolts 86. Other known plate heat exchanger methods may also be utilized. It is useful to have an attachment method in which the plates can easily be removed from one another during maintenance. The attachment method should provide an effective seal to prevent the loss of refrigerant and heat transfer fluid.

In accordance with the present invention, the heat transfer plates define apertures for entry and exit of the refrigerant and heat transfer fluid. Each heat transfer plate 12 and 14 defines a refrigerant supply aperture 88, a refrigerant exit aperture 90, a heat transfer supply aperture 92, and a heat transfer exit aperture 94. A corresponding tube can be provided for each respective aperture. FIG. 1 shows the refrigerant supply tube 96 and refrigerant exit tube 98 according to an embodiment of the present invention. Refrigerant supply tube 96 extends perpendicular to the heat transfer plates 12 and 14 and fits inside the refrigerant supply aperture 88. Refrigerant exit tube 98 extends perpendicular to the heat transfer plates 12 and 14 and fits inside the refrigerant exit aperture 90.

Holes or similar apertures are provided in each lengthwise portion of the refrigerant supply tube 96 that is contained in the first fluid channels 16 so that the refrigerant can exit the refrigerant supply tube 96 into the first fluid channel 16. The holes or apertures can be any suitable hole, aperture or other type of opening known in the art. Corresponding holes or apertures are also provided in the lengthwise portions of the refrigerant exit tube 98 that are contained in the first fluid channels 16 so that the refrigerant can exit the first fluid channel 16 and enter the refrigerant exit tube 98 to be carried away from the plate heat exchanger 10. Any suitable method of allowing the refrigerant to enter the first fluid channel through a supply means and exit through an exit means is acceptable. In addition, the means for supplying and exiting the heat exchanger is not limited to tubular members. Other known designs of transporting the refrigerant and heat transfer fluid are also within the scope of the present invention.

As embodied herein and shown in FIGS. 1, 2, and 5, a heat transfer fluid supply aperture 92 and corresponding heat transfer fluid exit aperture 94 are provided. A heat transfer fluid supply tube and heat transfer exit tube, not shown, are provided for the heat transfer supply aperture 92 and heat transfer fluid exit aperture 94, respectively, in a manner similar to the refrigerant tubes. Holes or similar apertures are provided in each lengthwise portion of the heat transfer fluid supply tube that is contained in the second fluid channel 18 so that the heat transfer fluid may exit the heat transfer fluid supply tube and enter the second fluid channel 18. Openings and designs similar to contemplated for the refrigerant tubes may be utilized. The heat transfer fluid, typically water, will enter the second fluid channels 18 through the openings in the heat transfer supply tube of the heat transfer supply aperture 92, flow downward along the heat transfer fluid flow surfaces of the heat transfer channel and exit the second fluid channels 18 through similar openings in the heat transfer exit tube of the heat transfer fluid exit aperture 94. The heat transfer fluid then exits the plate heat exchanger 10 in a cooled state through the heat transfer fluid exit aperture 94 and heat transfer exit tube. The preferred heat exchanger, as described in the present invention, is a counterflow-type of plate heat exchanger where the heat transfer fluid and refrigerant flow in opposite directions through the flow channels.

In the embodiment shown in FIGS. 1–10, heat transfer supply aperture 92 is provided on the upper portion of the heat exchanger 10, whereas heat transfer fluid exit aperture 94 is provided on the lower portion of the plate heat exchanger. The refrigerant supply aperture 88 is provided on the lower portion of the plate heat exchanger 10, whereas the refrigerant exit aperture 90 is provided on the upper portion of the plate heat exchanger 10. It should be understood that the plate heat exchanger could be modified so that the refrigerant enters the heat exchanger at the top and the heat transfer fluid enters at the bottom. In addition, the supply and exit tubes may be of any variety of sizes and shapes that are known in the art, and are not limited to the particular configuration shown in the drawings.

It should be understood that the plate heat exchanger shown in the drawings is exemplary only. A variety of conventional plate heat exchangers are suitable for use with the present invention.

In accordance with the present invention, the heat exchanger also includes an electrical connection structure for imparting voltage on the electrode plates. As embodied herein and shown in FIGS. 1, 5, and 6, an electrical connection structure 100 is provided for connecting the electrode plates 40 to a voltage source (not shown). In the preferred embodiment, the electrical connection structure is in the shape of a rod 100 that extends longitudinally in the refrigerant exit tube 98. The rod preferably includes threads so that the rod may be threaded through the electrode plates. In the embodiment shown in FIGS. 5–6, each electrode plate 40 is provided with a tab 102 having an hole 104 for the rod. The hole 104 of the tab 102 preferably includes internal threads for mating with external threads of the rod 100. The provision of threads provides for an improved connection between the rod and the hole. The threaded rod can simply be threaded through each of the aligned holes 104 of the electrode plates 40. The rods may be connected to the electrode plates by a variety of other connection methods besides the threaded rod and hole described above. Any alternate suitable connection method is acceptable. For example, the rod may be connected to the electrode plate with a compression fit inside the hole 104 of tab 102. In order to connect the rod to the electrode plate, the rod can be first frozen and then inserted into the hole 104. As the temperature of the rod gradually increases, the diameter of the rod will increase so that it is tightly fit inside the hole 104 of tab 102. In another alternate method, a wire is passed through or wrapped around each of the electrode plate tabs.

All of the above methods allow for a relatively simple assembly and disassembly of the electrical connection structure to and from the electrode plates. A variety of other suitable attachment methods can also be envisaged, as long as they provide for good mechanical and electrical connections.

The voltage is provided to the electrode plate from a voltage source applied to input connection 106. In the embodiment shown in FIG. 1, the input connection 106 passes through the wall of the refrigerant exit tube 98. The input connection 106 shown in FIG. 1 is a ceramic insulator in the shape of a spark plug, but with no gap for a spark.

Figure 10:
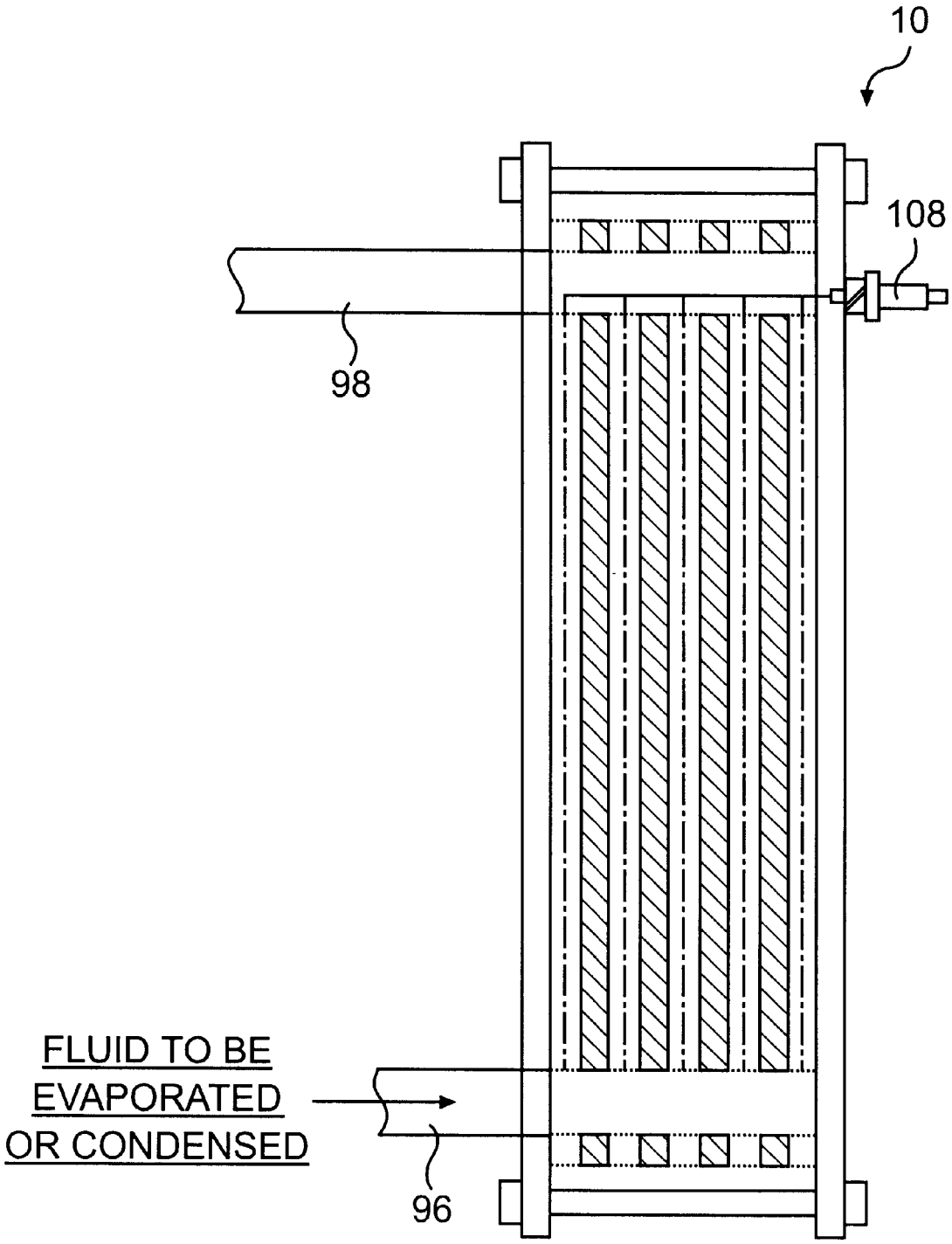
FIG. 10 is a cross-sectional side view of a plate heat exchanger with an electrical connection structure in an alternative location compared to FIG. 1.
Figure 11:
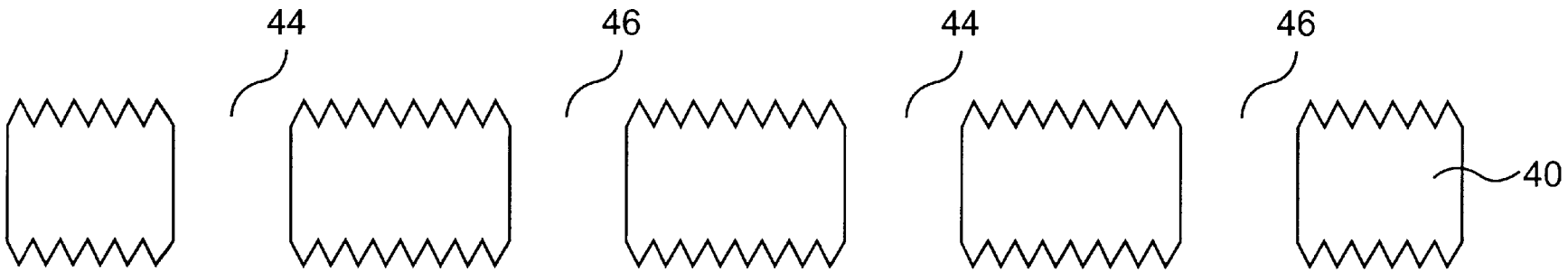
FIG. 11 is a cross-sectional side view of an electrode plate taken along line 11—11 of FIG. 6, illustrating surface irregularities having sharp points.

The input connection can be located at a variety of locations, for example, FIG. 10 shows an embodiment wherein a input connection 108 is located at the end of the refrigerant exit tube 98.

The electrode plates are maintained at high voltages relative to the heat transfer a plate, preferably between 5 and 30 kV. Therefore, a high voltage power source is required. For example, in an embodiment to be described below with a 100 ton capacity, a voltage of approximately 20 kV is desirable. The suitable voltage range varies depending upon the size, water flow, cooling rate desired, and selected materials of the plate heat exchanger. A wide variety of direct current high voltage power sources are suitable for connection with the input connection 106 (or 108) of the present invention. For example, a power source similar to that used in a television, or for lab instrumentation can be adapted for use with the present invention. It is desirable to minimize the amount of money expended on supplying power to the electrode plates. Therefore, it is desirable to have a system where a minimal amount of voltage will result in greatly enhanced heat transfer.

For any given application, the increase of the voltage through the electrode plates significantly increases the heat transfer rate of the heat exchanger, up until a point where the increased heat transfer becomes minimum or is so small as to not equal the cost for increased voltage. The best voltage for a given application can be determined through empirical testing. Generally, the voltage can be increased to a point where it is practically unfeasible to measure any increase in heat transfer. At this point the heat transfer rate is nearly infinite. One aspect of the present invention is to apply a sufficient voltage to achieve close to maximum potential heat transfer, while minimizing energy costs.

The provision of an electrode plate in the refrigerant channel provides enhanced heat rate between a refrigerant flowing around the electrode plate and a heat transfer fluid flowing on the other side of the heat transfer plates. As embodied in an evaporator made in accordance with the invention, the refrigerant flow surfaces of each pair of heat transfer plates are provided with surface irregularities. The provision of surface irregularities on the refrigerant flow surfaces of the heat transfer plates increases the surface area of the refrigerant flow surfaces, and increases the heat transfer which occurs across the heat transfer plates. An electrode plate is provided to produce an electric field on the refrigerant flow surface of each heat transfer plate when a voltage is applied to the electrode. The electric field is intensified at the surface irregularities, causing the refrigerant to be pressed against the surface irregularities on the refrigerant flow surface of the plates, thereby enhancing the heat transfer rate across the plate significantly.

The plate heat exchangers according to the present invention have an improved heat transfer coefficient. Because of the large increase in heat transfer coefficient that occurs with the present invention, the size of the heat exchangers for a particular application can be significantly decreased. Therefore, the present invention is especially suitable for HVAC systems where size constraints are important.

The operation of the apparatus will be described below. In the preferred embodiment, the heat exchanger is an evaporator, however, the present invention can also be used in a condenser with minor modifications which will be described later. For the sake of the discussion below, the operation will be described with regard to an evaporator.

A first fluid comprising a refrigerant flows into a refrigerant supply tube 96 that passes into the refrigerant supply aperture 88. The refrigerant then flows into each of the first fluid channels 16 through holes or apertures in the lengthwise portions of the refrigerant supply tube 96 that are located in the first fluid channels. The refrigerant flows upward from the bottom of the plate heat exchanger to the top of the heat exchanger in the first fluid channels 16. As the refrigerant flows upward, it passes along the refrigerant flow surfaces of the heat transfer plates 12 and 14. A predetermined voltage is applied to each of the electrode plates 40, thereby creating an electric field on the refrigerant flow surfaces of each heat transfer plate. The electric:

field forces the liquid refrigerant to be pressed up against surface irregularities provided on the refrigerant flow surfaces, thereby increasing the heat rate to a second fluid. The refrigerant then exits the first fluid channel through holes or apertures in the refrigerant exit tube 88, and leaves the heat exchanger.

The refrigerant exchanges heat with a second fluid comprising a heat transfer fluid flowing on the opposite side of the heat transfer plates, and preferably in the opposite direction. The heat transfer fluid is typically water, with additives such as propylene glycol (PG) or ethylene glycol (EG) in order to prevent the water from freezing. The heat transfer fluid flows into a heat transfer fluid supply tube that passes into the heat transfer supply aperture 92. The heat transfer fluid then flows into each of the second fluid channels 18 through holes or apertures in the lengthwise portions of the heat transfer fluid supply tube that are located in the second fluid channels. The heat transfer fluid then flows downward from the top of the plate heat exchanger to the bottom of the plate heat exchanger. As the refrigerant flows downward through the second fluid channel 18, it passes along the heat transfer fluid flow surfaces of the heat transfer plates 12 and 14, and transfers heat to the refrigerant flowing in the first fluid channels 16. As the heat transfer fluid flows across the heat transfer plates, the temperature of the heat transfer fluid decreases due to heat transfer to the refrigerant through the heat transfer plates. The refrigerant is at a lower temperature than the heat transfer fluid, therefore, heat is transferred from the heat transfer fluid to the refrigerant, thereby cooling the heat transfer fluid, while heating and ultimately evaporating some or all of the refrigerant.

The heat transfer fluid leaves the second fluid channels in a cooled state through holes or openings in the heat transfer fluid exit tube. The cooled heat transfer fluid, such as water, may then be used to cool ambient air via an HVAC system.

The present invention is suitable for use with plate heat exchangers having a wide range of sizes and shapes. The following description is for one typical plate heat exchanger, and is not meant to be limiting in any manner. The following are approximate sizes for one typical plate heat exchanger, as well as sizes for variants of the typical plate heat exchanger indicated in parenthesis: capacity =100 tons (0.00,1 to 1,000 tons); water flow rate=240 gallons/minute (0.001 to 2,400 gallons/minute); refrigerant flow rate=1.6 kg/s (0.001 to 160 kg/s); voltage=20 kV (5 to 30 kV); electrode plate thickness=1/32 in (1/64 to 1/16 in); heat transfer fluid channel width=3/16 in (1/16 to 1/2 in); refrigerant channel width=3/16 in (1/16 to 1/2 in); heat transfer plate thickness=1/32 in (1/64 to 1/16 in); width of heat transfer plate=15 in (0.5 to 120 in); height of plate=34 in (1 to 120 in); number of refrigerant channels=20 (1 to 1,000).

As is evident from the above description, the present invention includes a method for effectuating an exchange of heat between a heat transfer fluid and a refrigerant in a plate heat exchanger. The steps include: providing a plurality of parallel heat transfer plates; providing an electrode plate inside each of a plurality of first fluid channels defined by first surfaces of adjacent heat transfer plates, flowing the refrigerant through the plurality of first fluid channels, flowing the heat transfer fluid along a second surface of each of the heat transfer plates, the second surfaces of adjacent heat transfer plates defining a second fluid channel for the heat transfer fluid; and applying a voltage to each of the electrode plates to create an electric field, the electric field increasing the heat transfer rate between the refrigerant and the heat transfer fluid. The step of applying a voltage to each of the electrode plates includes; attaching an electrical connector to each of the electrode plates to supply the voltage to the plurality of electrode plates. In one embodiment, the step of providing a plurality of heat transfer plates includes forming surface irregularities on the first surfaces of the heat transfer plates. In another embodiment, the step of providing electrode plates includes forming surface irregularities on the outer surfaces of the electrode plates. In a further step, the electrode plate may be electrically insulated from the adjacent heat transfer plates. The step of applying a voltage to the electrodes typically includes applying a voltage between 5 to 30 kV.

Although the above description is directed toward the use of the present invention in an evaporator, the principles of the invention are also suitable for a condenser. In a condenser, the surface irregularities will be provided on the outer surfaces 42 of the electrode plates 40 and the smooth surface will be provided on the refrigerant flow surfaces of the heat transfer plates 12 and 14. The rough outer surfaces 42 of the electrode plate will promote a higher electric field along the outer surfaces of the electrode plates. The liquid refrigerant will be pulled toward the high electric field on the electrode plate. Because the liquid refrigerant is being pulled away from the refrigerant flow surface of the heat transfer surface, the refrigerant vapor will travel along the surface of the heat transfer plates 12 and 14. In a condenser, the heat transfer fluid flowing in the second fluid channels will absorb heat from the higher temperature refrigerant flowing through the first fluid channels, thereby causing the refrigerant to cool and condense in the tubes. The heat transfer fluid, typically water, will then recirculate to a cooling system such as a cooling tower.

The outer surfaces 42 of electrode plates 40 in the condenser may have a variety of different surface irregularities, similar to those described for the evaporator configuration. Suitable surface irregularities include, but are not limited to, cross-groove microfins, porous coatings, sintered surfaces, abrasions, and dimpled surfaces. Surface irregularities may also be provided by forming the electrode plate as a wire mesh in one embodiment of the condenser.

It will be apparent to those skilled in the art that various modifications and variations can be made in the apparatus and method for increasing the heat transfer rate of a heat exchanger, use of the apparatus of the present invention, and in construction of this apparatus, without departing from the scope or spirit of the invention.

Other embodiments of the invention will be apparent to those skilled in the art from consideration of the specification and practice of the invention disclosed herein. The present invention is suitable in any application where it is desirable to improve the heat transfer characteristics between two fluids. It is intended that the specification and examples be considered as exemplary only, with a true scope and spirit of the invention being indicated by the following claims.

What is claimed is:

1. A plate heat exchanger for accommodating two circulating heat exchange mediums, comprising:

a plurality of heat transfer plates mounted in parallel relationship to each other defining alternating fluid channels comprising first and second fluid channels, the first fluid channel for containing a first heat exchange medium, the second fluid channel for containing a second heat exchange medium; and an electrode plate located in each first fluid channel and positioned generally parallel to and spaced from the heat transfer plates, the electrode plate including outer electrode surfaces on each side thereof to produce an electric field, wherein the outer electrode surfaces of each electrode plate include surface irregularities having sharp points, and wherein the electric field is intensified at the sharp points of the surface irregularities to pull the first heat exchange medium toward the surface irregularities to increase the heat transfer rate between the first heat exchange medium and the second heat exchange medium.

2. The plate heat exchanger of claim 1, further comprising insulators for electrically insulating the electrode plate from the surrounding heat transfer plates, said insulators supporting the electrode plate in its respective first fluid channel.

3. The plate heat exchanger of claim 2, wherein said insulators contact the heat transfer plates that surround the electrode plate.

4. The plate heat exchanger of claim 1, wherein each electrode plate is positioned substantially equidistant from the two adjacent heat transfer plates that define the first fluid channel.

5. The plate heat exchanger of claim 1, wherein each heat transfer plate defines apertures for entry and exit of each of the first and second heat exchange mediums.

6. The plate heat exchanger of claim 5, further comprising an electrical connector for imparting electrical voltage on the electrode plates, the electrode plates being electrically connected to one another by the electrical connector.

7. The plate heat exchanger of claim 6, wherein the electrical connector comprises one of a rod, wire, and threaded rod passing through one of the apertures for entry and exit of the first heat exchange medium.

8. The plate heat exchanger of claim 1, wherein the plate heat exchanger comprises a condenser.

9. The plate heat exchanger of claim 8, wherein the heat transfer plate surfaces surrounding each electrode plate and defining the first fluid channels are substantially smooth.

10. The plate heat exchanger of claim 8, wherein the electrode plate is a wire mesh.

11. The plate heat exchanger of claim 1, wherein said first heat exchange medium in the first fluid channel comprises a refrigerant, and said second heat exchange medium in the second fluid channel comprises a heat transfer fluid.

12. A plate heat exchanger for accommodating two circulating heat exchange mediums, comprising:

a plurality of heat transfer plates mounted in parallel relationship to each other defining alternating fluid channels comprising first and second fluid channels, the first fluid channel for containing a first heat exchange medium, the second fluid channel for containing a second heat exchange medium;

an electrode plate located in each first fluid channel and positioned generally parallel to and spaced from the heat transfer plates, the electrode plate including outer electrode surfaces on each side thereof to produce an electric field and a plurality of holes; and insulators passing through the plurality of holes of the electrode plate for electrically insulating the electrode plate from the surrounding heat transfer plates, said insulators supporting the electrode plate in its respective first fluid channel, wherein either the outer electrode surfaces of each electrode plate, or the surfaces of the heat transfer plates surrounding each electrode plate and defining the first fluid channel, include surface irregularities, and wherein the effect of the electric field on the surface irregularities is an increase in the heat transfer rate between the first heat exchange medium and the second heat exchange medium.

13. The plate heat exchanger of claim 12, wherein dimples are formed on the surfaces of the heat transfer plates and said electrode plate includes a plurality of holes for accepting said dimples.

14. The plate heat exchanger of claim 13, wherein said dimples for contacting the insulators and said dimples accepted by the electrode holes are stamped onto the heat transfer plates.

15. A plate heat exchanger for accommodating two circulating heat exchange mediums, comprising:

a plurality of heat transfer plates mounted in parallel relationship to each other defining alternating fluid channels comprising first and second fluid channels, the first fluid channel for containing a first heat exchange medium, the second fluid channel for containing a second heat exchange medium, each heat transfer plate defining apertures for entry and exit of each of the first and second heat exchange mediums;

an electrode plate located in each first fluid channel and positioned generally parallel to and spaced from the heat transfer plates, the electrode plate including outer electrode surfaces on each side thereof to produce an electric field and a projection; and an electrical connector for imparting electrical voltage on the electrode plates, the electrical connector comprising one of a rod, wire, and threaded rod passing through one of the apertures for entry and exit of the first heat exchange medium and through the projections of the electrode plates to electrically connect the electrode plates to one another, wherein either the outer electrode surfaces of each electrode plate, or the surfaces of the heat transfer plates surrounding each electrode plate and defining the first fluid channel, include surface irregularities, and wherein the effect of the electric, field on the surface irregularities is an increase in the heat transfer rate between the first heat exchange medium and the second heat exchange medium.

16. The plate heat exchanger of claim 15, wherein the electrical connector is compression fit inside an opening in the electrode plate projection.

17. A plate heat exchanger for accommodating a circulating refrigerant and heat transfer fluid, comprising:

a plurality of heat transfer plates mounted in parallel relationship to each other defining alternating flow spaces for a refrigerant and a heat transfer fluid; and an electrode plate located in each refrigerant flow space and spaced from the adjacent heat transfer plates, the electrode plate including outer electrode surfaces or each side thereof to produce an electric field, wherein the outer electrode surfaces of the electrode plates include surface irregularities having sharp points, and wherein the electric field is intensified at the sharp points of the surface irregularities to pull the refrigerant toward the surface irregularities to increase the heat transfer rate between the refrigerant and heat transfer fluid.

18. The plate heat exchanger of claim 17, wherein the electrode plate is substantially flat-shaped and is substantially parallel to the heat transfer plates.

19. The plate heat exchanger of claim 17, wherein the electrode plate is positioned substantially equidistant from the adjacent heat transfer plates in the refrigerant flow space.

20. A plate heat exchanger for accommodating a circulating refrigerant and heat transfer fluid, comprising:

a plurality of heat transfer plates mounted in parallel relationship to each other defining alternating flow spaces for a refrigerant and a heat transfer fluid; and an electrode plate located in each refrigerant flow space and spaced from the adjacent heat transfer plates, the electrode plate including outer electrode surfaces on each side thereof to produce an electric field, wherein the outer electrode surfaces of the electrode plates include surface irregularities, the surface irregularities including one of cross-groove microfins, porous coatings, scratched surfaces, sintered surfaces, abraided surfaces, and dimpled surfaces, wherein the effect of the electric field is an increase in the heat transfer rate between the refrigerant and heat transfer fluid.

21. A heat exchanger assembly for use in an HVAC system, comprising:

a stacked array of heat transfer plates mounted in parallel relationship to each other to define a plurality of first flow spaces for a first heat exchange medium and a plurality of second flow spaces for a second heat exchange medium;

a plurality of electrode plates, an electrode plate being positioned in each of the first flow spaces, the electrode plates having outer surfaces to produce an electric field, wherein the outer surfaces of the electrode plates include surface irregularities having sharp points, and wherein the electric field is intensified at the sharp points of the surface irregularities to pull the first heat exchange medium toward the surface irregularities to increase the heat transfer rate between the first heat exchange medium and the second heat exchange medium.

22. The heat exchanger assembly of claim 21, wherein the plate heat exchanger comprises a condenser.

23. The heat exchanger assembly of claim 21, wherein the electrode plate is positioned substantially equidistant from the adjacent heat transfer plates in the first flow space.

24. A method of exchanging heat between a heat transfer fluid and a refrigerant in a plate heat exchanger, comprising the steps of:

providing a plurality of parallel heat transfer plates;

providing an electrode plate inside each of a plurality of first flow spaces defined by first surfaces of adjacent heat transfer plates;

forming surface irregularities having sharp points on the outer surfaces of the electrode plates;

flowing the refrigerant through the plurality of first flow spaces;

flowing the heat transfer fluid along a second surface of each of the heat transfer plates, said second surfaces of adjacent heat transfer plates defining a second flow space for the heat transfer fluid; and applying a voltage to the electrode plates to create an electric field, said electric field being intensified at the sharp points of the surface irregularities to pull the refrigerant toward the surface irregularities and thereby increasing the heat transfer rate between the refrigerant and the heat transfer fluid.

25. The method of claim 24, wherein said step of applying a voltage to the electrode plates includes attaching an electrical connector to each of the electrode plates to supply the voltage to the plurality of electrode plates.

26. The method of claim 24, further comprising the step of electrically insulating the electrode plate from the adjacent heat transfer plates.

27. The method of claim 24, wherein the electrode plate is positioned substantially equidistant from the adjacent heat transfer plates.

28. The method of claim 24, wherein the step of applying a voltage to the electrode plates includes applying a voltage between 5 to 30 kV.

29. The method of claim 28, wherein the applied voltage is approximately 20 kV.

30. A plate heat exchanger for accommodating a circulating refrigerant and heat transfer fluid, comprising:

opposing plates with sets of aligned outwardly and inwardly extending dimples, the first set of aligned dimples extending inwardly towards each other, the second set of aligned dimples extending outwardly away from each other to create an open space;

an electrode plate positioned between the opposing plates, the electrode plate having holes aligned with the dimples; and an insulator in the open space to hold and be positioned in the outwardly extending dimples and to pass through an aligned hole of the electrode plate, wherein said inwardly extending dimples pass through an aligned hole of the electrode plate and touch each other.

* * * * *

UNITED STATES PATENT AND TRADEMARK OFFICE

CERTIFICATE OF CORRECTION

PATENT NO. : 6,357,516 B1
DATED : March 19, 2002
INVENTOR(S) : John F. Judge et al.

It is certified that error appears in the above-identified patent and that said Letters Patent is hereby corrected as shown below:

Column 15,
Line 30, "electric, field" should read -- electric field --.
Line 44, "or" should read -- on --.

Signed and Sealed this

Fourth Day of June, 2002

*Attest:*

*Attesting Officer*

JAMES E. ROGAN
*Director of the United States Patent and Trademark Office*